US006377133B1

(12) United States Patent
Ihmels et al.

(10) Patent No.: US 6,377,133 B1
(45) Date of Patent: Apr. 23, 2002

(54) VARIABLE POWER DIVIDER/COMBINER

(75) Inventors: Ralf Ihmels, Redondo Beach; Chris Trammell, La Harba, both of CA (US)

(73) Assignee: Hughes Electronics Corporation, Segundo, CA (US)

( * ) Notice: Subject to any disclaimer, the term of this patent is extended or adjusted under 35 U.S.C. 154(b) by 0 days.

(21) Appl. No.: 09/528,604

(22) Filed: Mar. 20, 2000

(51) Int. Cl.[7] ..... H01P 1/18; H01P 1/32
(52) U.S. Cl. ..... 333/158; 333/24.1
(58) Field of Search ..... 333/24.1, 158

(56) References Cited

U.S. PATENT DOCUMENTS 4,492,938 A 1/1985 Young
4,884,045 A * 11/1989 Alverson et al. ..... 333/158

FOREIGN PATENT DOCUMENTS

EP 0156294 10/1985
EP 0325340 7/1989
JP 60187103 9/1985

* cited by examiner

*Primary Examiner*—Robert Pascal
*Assistant Examiner*—Kimberly E. Glenn
(74) *Attorney, Agent, or Firm*—Terje Gudmestad

(57) ABSTRACT

A waveguide continuously variable power divider/combiner that is capable of dividing one input signal into two output signals, with the ratio of the output signals being continuously variable between zero and infinity. The waveguide has a first septum polarizer separated from a second septum polarizer by a ferrite phase shifter. By adjusting the magnetic bias in the ferrite phase shifter, a predetermined phase differential is generated thereby modifying an input signal as desired.

16 Claims, 1 Drawing Sheet

VARIABLE POWER DIVIDER/COMBINER

TECHNICAL FIELD

The present invention relates to a waveguide variable power divider/combiner, and more particularly to a continuously variable power divider/combiner having a differential phase shifter.

BACKGROUND ART

Communication satellites employ power dividers/combiners for a variety of applications. For example, communication satellite systems require that the antenna provide a number of separate beams operating on the same frequency. The antenna must be capable of switching, or reconfiguring, the beams to accommodate changing traffic patterns. Power dividers/combiners are used to provide this much-needed flexibility in the antenna system.

Typically, waveguide variable power dividers/combiners are comprised of two orthomode transducers with a movable, or rotating phase shifter therebetween.

There are several variations of variable power divider/combiners, including a spiral septum mounted on a rotatable shaft wherein rotation of the shaft moves the septum in such a way so as to change the resonant frequency. Also known, is a rotary joint that orients a flexible septum positioned within a hollow waveguide. The rotary joint positions various system components with respect to each other with a minimum of waste space to apply energy to, or derive energy from, an antenna structure.

Another known variable power divider/combiner is a series of rectangular waveguides that are manually rotatable relative to one another to create a rotated wave. Also known, is a variable power divider having first and second orthomode transducers coupled together by a hollow waveguide having a spiral plate rotator therebetween.

The moving parts required by the phase shifter in all of these examples introduce the need for mechanical parts, i.e. motors, actuators, gears, bearings, choke joints, etc., which are prone to component failure and malfunction. Also, the motors, actuators, gears, etc. are relatively heavy and sizable. In addition, the inertial mass must be accelerated for switching. As a result, the switching speed is limited by the inertial mass.

Prior art non-mechanical power divider/combiner technologies are known. However, there are significant drawbacks associated with the known non-mechanical devices. For example, known devices may be capable of shifting the phase of an incoming signal without the need for moving parts, but cannot combine different signals sources or divide a single incoming signal into more than one outgoing source.

SUMMARY OF THE INVENTION

The present invention is a waveguide variable power divider/combiner that has no mechanically moving parts. The present invention has two septum polarizers with a ferrite differential phase shifter therebetween. Changing the bias magnetic field, H, in the ferrites controls the differential phase between two spatially orthogonal modes. Each septum polarizer has two ports that can be designated as input and output ports.

Depending on the differential phase in the ferrite section, the input power can be split between two output ports in any ratio. The ratio of the output signals is continuously variable between zero and infinity. With two input signals of a predetermined frequency and appropriate phase, the power divider/combiner of the present invention will combine both signals and make the combined signal accessible at one or the other of two output ports.

It is an advantage of the present invention that no mechanical actuators are needed. The present invention is lighter than prior art devices making it suitable for any spacecraft application in any frequency band. Additionally, the present invention is suitable for radar as well.

It is an object of the present invention to provide a waveguide variable power divider/combiner that has no movable parts. It is another object of the present invention to control the differential phase by changing the bias magnetic field in a ferrite differential phase shifter.

It is a further object of the present invention to provide a ratio of output signals that is continuously variable between zero and infinity. It is still a further object of the present invention to reduce the size and weight of a power divider/combiner, while improving the switching speed.

Other objects and features of the present invention will become apparent when viewed in light of the detailed description of the preferred embodiment when taken in conjunction with the attached drawings and appended claims.

BRIEF DESCRIPTION OF THE DRAWINGS

In order that the invention may be well understood, there will now be described, an embodiment thereof, given by way of example, reference being made to the accompanying drawings, in which.

BEST MODE(s) FOR CARRYING OUT THE INVENTION

Figure 1:
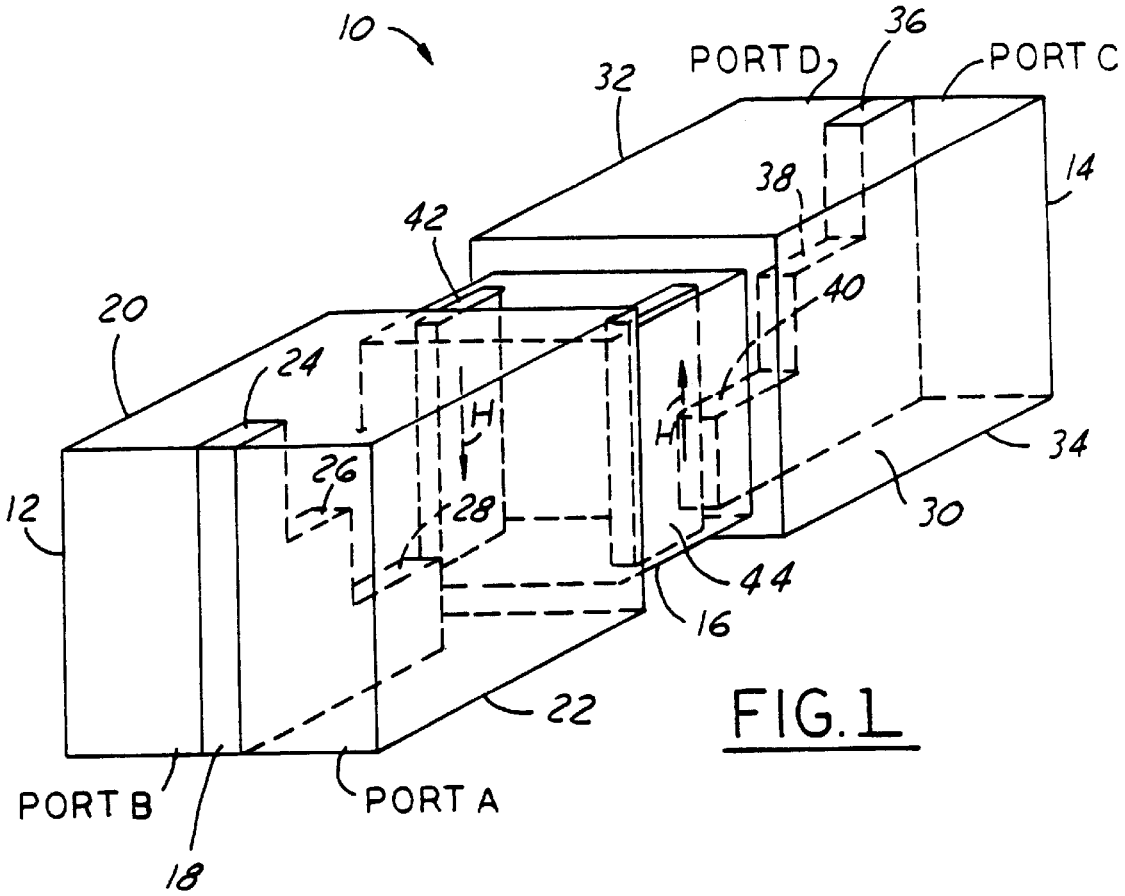
FIG. 1 is a perspective view, shown in partial cut-away, of a waveguide variable power divider/combiner of the present invention.

FIG. 1 is a perspective view of the waveguide variable power divider/combiner 10 of the present invention. It should be noted that while a square waveguide is shown, it is possible to substitute any other waveguide and accomplish the same results. The variable power divider/combiner 10 has a first septum polarizer 12 and a second septum polarizer 14 with a ferrite differential phase shifter 16 located therebetween.

The first septum polarizer 12 has a septum 18 therein that defines two ports, A and B. The septum 18 extends vertically across the interior of the waveguide 10 between the top and bottom walls 20 and 22 of the waveguide and parallel to the side walls. In the preferred embodiment shown in FIG. 1, the septum 18 has a plurality of steps 24, 26 and 28 that descend along the interior of the waveguide 10 in the direction of the phase shifter 16. The step 24 is the only portion of the septum 18 that spans the internal height of the waveguide 10 to connect the top and bottom walls. The septum 18 is designed to convert the polarization of a first signal applied to one of the ports from a first polarization to a second polarization.

The second septum polarizer 14 has a septum 30 therein that also extends vertically across the interior of the waveguide 10 between the top and bottom walls 32 and 34 of the waveguide 10 and parallel to the side walls. The second septum 30 also has a plurality of steps 36, 38 and 40 that descend along the interior of the waveguide 10 in the direction of the phase shifter 16. The step 36 is the only portion of the septum 30 that spans the internal height of the waveguide 10 to connect the top and bottom walls 32 and 34.

The second septum polarizer 14 is designed to split the signal components evenly between two output ports, C and D, in any ratio.

The ferrite phase shifter 16 is disposed between and coupled to the first and second septum polarizers 12 and 14 as shown in FIG. 1. The phase shifter 16 has two ferrite slabs 42, 44 to support a circularly polarized wave (CPW), which interacts with a longitudinal magnetic field, H. A desired phase shift is achieved by adjusting the bias magnetic field along the axis of the ferrite slabs 42, 44.

In operation, the waveguide power divider/combiner 10 of the present invention controls the differential phase between two spatially orthogonal modes, such as $TE_{10}$ and $TE_{01}$ in a square waveguide. This is accomplished by changing the bias magnetic field, H, in the ferrite slabs 42, 44. For example, the first septum polarizer 12 will convert a linear polarized input signal to a circular polarized signal within the ferrite phase shifter 16. Since the circularly polarized wave consists of two spatially orthogonal modes, a $TE_{10}$ component and a $TE_{01}$ component with a 90° differential phase, the latter component can be controlled by altering the bias magnetic field, H, in the ferrites, without changing the magnitudes.

The ferrite slabs 42, 44 are parallel to the transverse magnetic field of the $TE_{01}$ component and perpendicular to the magnetic field of the $TE_{10}$ component. Their individual propagation characteristics, and hence the differential phase can be controlled by varying the bias magnetic field, H.

The second septum polarizer 14 will split the components evenly and add another 90° differential phase. Depending on the differential phase in the ferrite section, the input power can be split between the two output ports, C and D, in any ratio.

The waveguide variable power divider/combiner 10 of the present invention is capable of dividing one input signal into two output signals, with the ratio of the output signals being continuously variable between zero and infinity. By switching the differential phase between 0° and 180°, the output signal can be switched between the two output ports C and D. A 3-dB split can be accomplished with a 90° differential phase. With two input signals of a predetermined frequency and appropriate phase, the present invention will combine both signals and make the combined signal accessible at on or the other of two ports.

With no differential phase generated in the ferrite section, ($\Delta\gamma=0°$), the input signal at port A will be routed to the output port D, because the two modal portions are 180° out of phase at port C, and therefore cancel out. Setting the magnetic bias in the ferrite section in a way that $\Delta\gamma=180°$, the input signal will be routed from port A to port C. In these two states, the present invention acts as a fast switch. For any other angle $\Delta\gamma$ different from 0° or 180°, no cancellation will occur at any of the two output ports. The present invention then acts as a continuously variable power divider.

For $\Delta\gamma=90°$, the present invention is a 3-dB power divider routing the input signal from port A to port C and port B in equal portions. As a power combiner, the present invention can be used to generate a combined signal at port A or port B from two input signals at ports D and C. The input signals can be of different or equal magnitude.

It should be noted that while the present invention is being described in a preferred embodiment it is possible to modify the present invention without departing from the scope of the appended claims. For example, it is possible to substitute any other waveguide for the rectangular waveguide described herein. It is also possible to substitute another type of ferrite phase shifter for the slab ferrite phase shifter described herein and accomplish the same results as the present invention. Accordingly, the present invention should not be limited to the specific embodiments described herein, but should be accorded the broadest scope consistent with the principles and features disclosed herein.

What is claimed is:

1. A fast switch comprising:

a first septum polarizer defining port A and port B;

a second septum polarizer defining port C and port D;

a ferrite phase shifter disposed therebetween having a predetermined phase differential of 0° between two spatially orthogonal modes of a signal and an input signal at said port A is routed to port D.

2. A fast switch comprising:

a first septum polarizer defining port A and port B;

a second septum polarizer defining port C and port D;

a ferrite phase shifter disposed therebetween having a predetermined phase differential of 180° between two spatially orthogonal modes of a signal and an input signal at said port A is routed to port C.

3. A waveguide variable power divider/combiner comprising:

a first septum polarizer defining port A and port B;

a second septum polarizer defining port C and port D; and a ferrite phase shifter disposed therebetween for controlling a phase differential to 90° between two spatially orthogonal modes of a signal and an input signal at port A is divided equally between ports C and D.

4. The power divider/combiner as claimed in claim 3 wherein said first and second septum polarizers each further comprise a septum having a plurality of descending steps.

5. The power divider/combiner as claimed in claim 3 wherein said first and second septum polarizers each further comprise a septum having a plurality of descending steps.

6. A waveguide variable power divider/combiner comprising:

a first septum polarizer defining port A and port B;

a second septum polarizer defining port C and port D; and a ferrite phase shifter disposed therebetween for controlling a phase differential to 90° between two spatially orthogonal modes of a signal and two signals at ports C and D with 90° phase offset with respect to each other are combined at one of ports A or B.

7. The power divider/combiner as claimed in claim 6 wherein said first and second septum polarizers each further comprise a septum having a plurality of descending steps.

8. The power divider/combiner as claimed in claim 6 wherein said first and second septum polarizers each further comprise a septum having a plurality of descending steps.

9. A method for fast switching having a first septum polarizer defining ports A and B, a second septum polarizer defining ports C and D, and a ferrite phase shifter disposed therebetween, said method comprising the steps of:

setting a magnetic bias ferrite phase shifter such that a predetermined phase differential is 0°; and routing an input signal from port A to port D.

10. A method for fast switching having a first septum polarizer defining ports A and B, a second septum polarizer defining ports C and D, and a ferrite phase shifter disposed therebetween, said method comprising the steps of:

setting a magnetic bias ferrite phase shifter such that a predetermined phase differential is 180°; and routing an input signal from port A to port C.

11. A method for continuously variable power dividing/combining in a waveguide having first and second septum polarizers coupled to each other by a ferrite phase shifter, said method comprising the steps of:

inputting a signal at said first septum polarizer;

generating a phase differential of 0° to route said input signal from a first port in said first septum polarizer to a first port in said second septum polarizer; and outputting a modified signal at said second septum polarizer.

12. A method for continuously variable power dividing/combining in a waveguide having first and second septum polarizers coupled to each other by a ferrite phase shifter, said method comprising the steps of:

inputting a signal at said first septum polarizer;

generating a phase differential of 180° to route said input signal from a first port in said first septum polarizer to a second port in said second septum polarizer; and outputting a modified signal at said second septum polarizer.

13. A method for continuously variable power dividing/combining in a waveguide having first and second septum polarizers coupled to each other by a ferrite phase shifter, said method comprising the steps of:

inputting a signal at said first septum polarizer;

generating a phase differential; and outputting a modified signal at said second septum polarizer such that a ratio of said output signals is continuously variable between zero and infinity.

14. A method for continuously variable power dividing/combining in a waveguide having first and second septum polarizers coupled to each other by a ferrite phase shifter, said method comprising the steps of:

inputting a signal at said first septum polarizer;

generating a phase differential of 90°; and outputting a modified signal at said second septum polarizer.

15. The method as claimed in claim 14 further comprising the steps of:

splitting said input signal from one of said first and second ports in said first septum polarizers; and outputting said split signal at said first and second ports in said second septum polarizer.

16. The method as claimed in claim 14 further comprising the steps of:

combining a signal at said first port of said second septum polarizer with a signal at said second port of said second septum polarizer; and outputting said combined signal at one of said first and second ports of said first septum polarizer.

* * * * *